US009236021B2

(12) United States Patent
Zeng et al.

(10) Patent No.: US 9,236,021 B2
(45) Date of Patent: Jan. 12, 2016

(54) DRIVING METHOD AND CIRCUIT FOR LIQUID CRYSTAL DISPLAY PANEL

(71) Applicant: Shenzhen China Star Optoelectronics Technology Co., Ltd., Shenzhen, Guangdong (CN)

(72) Inventors: Dekang Zeng, Shenzhen (CN); Jiehui Qin, Shenzhen (CN); Xiaoping Tan, Shenzhen (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 62 days.

(21) Appl. No.: 14/234,148

(22) PCT Filed: Jan. 3, 2014

(86) PCT No.: PCT/CN2014/070081

§ 371 (c)(1),
(2) Date: Jan. 21, 2014

(87) PCT Pub. No.: WO2015/100728

PCT Pub. Date: Jul. 9, 2015

(65) Prior Publication Data

US 2015/0194113 A1 Jul. 9, 2015

(30) Foreign Application Priority Data

Dec. 30, 2013 (CN) ..... 2013 1 0747086

(51) Int. Cl.
*G09G 3/36* (2006.01)

(52) U.S. Cl.
CPC ..... *G09G 3/3674* (2013.01); *G09G 2310/0202* (2013.01); *G09G 2310/067* (2013.01); *G09G 2310/08* (2013.01)

(58) Field of Classification Search
CPC ..... G09G 2310/06; G09G 3/3696; G09G 3/3688; G09G 3/2011; G09G 3/3614
USPC ..... 345/87–104
See application file for complete search history.

(56) References Cited

U.S. PATENT DOCUMENTS

| | | | | |
|---|---|---|---|---|
| 7,061,462 | B1 * | 6/2006 | Pirš et al. | 345/96 |
| 2002/0011999 | A1 * | 1/2002 | Kim | 345/204 |
| 2005/0140619 | A1 * | 6/2005 | Hong | 345/87 |

FOREIGN PATENT DOCUMENTS

| | | | |
|---|---|---|---|
| CN | 1629925A | A | 6/2005 |

* cited by examiner

*Primary Examiner* — Temesgh Ghebretinsae
*Assistant Examiner* — Lisa Landis
(74) *Attorney, Agent, or Firm* — Andrew C. Cheng

(57) ABSTRACT

The present invention provides a driving method for a liquid crystal display panel, comprising a timing-driven process, wherein the timing-driven process includes the steps of: generating an initial pulse signal, which has a first rising edge rising from a low voltage to a high voltage and a first falling edge falling from the high voltage to the low voltage; and generating a timing pulse signal, which has a second rising edge rising from a low voltage to an intermediate voltage, a third rising edge rising from the intermediate voltage to a high voltage, a second falling edge falling from the high voltage to the intermediate voltage, and a third falling edge falling from the intermediate voltage to the low voltage. At the same time, the present invention further provides a driving circuit for a liquid crystal display panel.

6 Claims, 1 Drawing Sheet

DRIVING METHOD AND CIRCUIT FOR LIQUID CRYSTAL DISPLAY PANEL

FIELD OF THE INVENTION

The present invention relates to a technical field of a liquid crystal display, and more particularly to a driving method and a driving circuit for a liquid crystal display panel.

BACKGROUND OF THE INVENTION

With development of the modern technology, more and more novel information products are available to the market so as to meet the requirements from the public. In the past, the display is generally made from cathode ray tube (CRT). However, not only has it a bulky size and extensive energy consumption, but also emit extensive radiation which is detrimental to the viewer if exposed for an extended period of time. Accordingly, the liquid crystal display (LCD) has gradually replaced the traditional CRT monitor.

Liquid crystal displays available in the market today are mainly referred to as backlit liquid crystal display, which includes a liquid crystal display panel and a backlight module. The liquid crystal display panel comprises scan lines and control lines crisscrossed with each other; wherein data lines are controlled by data-driven chips which receive data start signal TP1 (latched pulse) and then output the data voltage to the data lines of the liquid crystal display panel on the falling edge; and wherein the scan lines are controlled by scan-driven chips set on both sides of the liquid crystal display panel. Currently, there are three control signals for controlling the switch of scan-driven chips on each line of the liquid crystal display panel, such as shown in FIG. 1, including a start voltage pulse (STV) signal for controlling the initiation of scanning first line; a clock voltage pulse (CKV) signal for providing a shift register to the scan-driven chip, controlling the switching frequency of each line, and starting operation when detecting the STV of a rising edge is a high voltage; and an output enable (OE) signal, respectively, wherein the pulse signal of the OE signal includes the rising edge of the CKV signal. Because there is a parasitic capacitance in the liquid crystal display panel, delays will occur during the process of scanning output voltage to the liquid crystal display panel, and there is a problem of overlap between the lines and lines when switching, resulting in overlapping areas, and this will cause a problem of filling the incorrect data. After the OE is added, the high voltage of the OE will lower the scanning output voltage strongly. Hence, the OE is placed between lines and lines when switching, forcing the adjacent scan lines not to form the overlapping area caused by switching on simultaneously anymore, so the time of overlapping switch on is prevented, and thereby the problem of filling the wrong data is also prevented.

The control signal of the scan-driven chip will be transmitted from a printed circuit board assembly (PCBA), and transmitted to a glass of a liquid crystal display panel via a flexible circuit board of a data chip, and then reached to a scan-driven chip through a glass conducting trace. The current mainstream of the liquid crystal display panel is designed to a narrow-boarder frame, and the cost of increasing a signal is to increase one more conducting trace on the glass, so the edge of the glass will be occupied. In addition, there will be one more signal on a timing-controller (T-CON) chip, and the manufacturing cost will increase.

SUMMARY OF THE INVENTION

In order to resolve the technical issue encountered by the prior art, the object of the present invention is to provide a driving method and a driving circuit for a liquid crystal display panel which can reduce conducting traces of the liquid crystal display panel and lower the manufacturing cost.

In order to achieve the above objects, the present invention provides a driving method for a liquid crystal display panel, comprising a timing-driven process, wherein the timing-driven process includes the steps of: A. generating an initial pulse signal, which has a first rising edge rising from a low voltage to a high voltage and a first falling edge falling from the high voltage to the low voltage; and B. generating a timing pulse signal, which has a second rising edge rising from a low voltage to an intermediate voltage, a third rising edge rising from the intermediate voltage to a high voltage, a second falling edge falling from the high voltage to the intermediate voltage, and a third falling edge falling from the intermediate voltage to the low voltage.

Wherein a scan-driven process is further included, including the steps of: a receiving step for receiving a control signal from a timing-driven circuit; a converting step for generating a target control signal based on the control signal; and an outputting step for outputting a scan-driven signal used for driving a liquid crystal display panel based on the target control signal.

Wherein the target control signal includes a start voltage pulse signal, a clock voltage pulse signal, and an output enable signal.

Wherein the converting step includes the sub-steps of: converting the initial pulse signal into a start voltage pulse signal; converting the timing pulse signal into a clock voltage pulse signal and an output enable signal, wherein a rising edge of the clock voltage pulse signal is a third rising edge of the timing pulse signal; a falling edge of the clock voltage pulse signal is a third falling edge of the timing pulse signal; a rising edge of the output enable signal is a second rising edge of the timing pulse signal; and a falling edge of the output enable signal is a second falling edge of the timing pulse signal.

Wherein the control signal includes a preceding initial pulse signal and a plurality of following timing pulse signals within a valid display time.

The other object of the present invention is to provide a driving circuit for a liquid crystal display panel, comprising a timing-driven chip, a scanning line, and a scan-driven chip coupled to the scanning line, wherein the timing-driven chip transmits a control signal to the scan-driven chip, and wherein the control signal includes an initial pulse signal, which has a first rising edge rising from a low voltage to a high voltage and a first falling edge falling from the high voltage to the low voltage; and a timing pulse signal, which has a second rising edge rising from a low voltage to an intermediate voltage, a third rising edge rising from the intermediate voltage to a high voltage, a second falling edge falling from the high voltage to the intermediate voltage, and a third falling edge falling from the intermediate voltage to the low voltage.

Wherein there is only one conducting trace for transmitting the control signal between the timing-driven chip and the scan-driven chip.

Wherein the scan-driven chip includes a decoding module for converting the control signal into a target control signal, and the scan-driven chip outputs a scan-driven signal for driving the liquid crystal display panel based on the target control signal.

Wherein the target control signal includes a start voltage pulse signal, a clock voltage pulse signal, and an output enable signal.

Wherein the decoding module converts the initial pulse signal into the start voltage pulse signal and converts the timing pulse signal into the clock voltage pulse signal and the output enable signal, wherein a rising edge of the clock voltage pulse signal is a third rising edge of the timing pulse signal; a falling edge of the clock voltage pulse signal is a third falling edge of the timing pulse signal; a rising edge of the output enable signal is a second rising edge of the timing pulse signal; and a falling edge of the output enable signal is a second falling edge of the timing pulse signal.

Wherein the control signal includes a preceding initial pulse signal and a plurality of following timing pulse signals within a valid display time.

Wherein the control signal includes a preceding initial pulse signal and a plurality of following timing pulse signals within a valid display time.

According to the driving method and the driving circuit for a liquid crystal display panel provided by the present invention, the timing-driven chip transmits a control signal to the scan-driven chip, and the scan-driven chip decodes the control signal to the start voltage pulse signal, the clock voltage pulse signal, and the output enable signal for controlling the output of the scan signal. Thus, there will only need one conducting trace for transmitting the control signal between the timing-driven chip and the scan-driven chip, and thereby the conducting trace of a liquid crystal display panel can be reduced, which can reduce the difficulty of design and the manufacturing cost.

DETAILED DESCRIPTION OF PREFERRED EMBODIMENTS

Now, a detailed description will be given with respect to preferred embodiments provided and illustrated here below with accompanied drawings. The legends are shown in the accompanied drawings, wherein the same legends always indicate the same or the substantially identical parts. In order to give a better and thorough understanding to the whole and other intended purposes, features and advantages of the present invention or the technical solution of the prior art, detailed description will be given with respect to preferred embodiments provided and illustrated here below in accompanied drawings.

Figure 1:
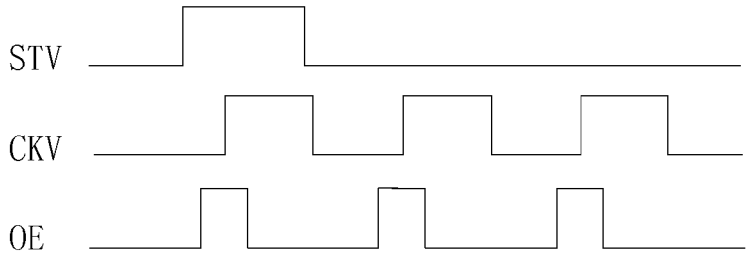
Figure 1 (Prior Art)
FIG. 1 is a structural and illustrational view of a prior art driving waveform.
Figure 2:
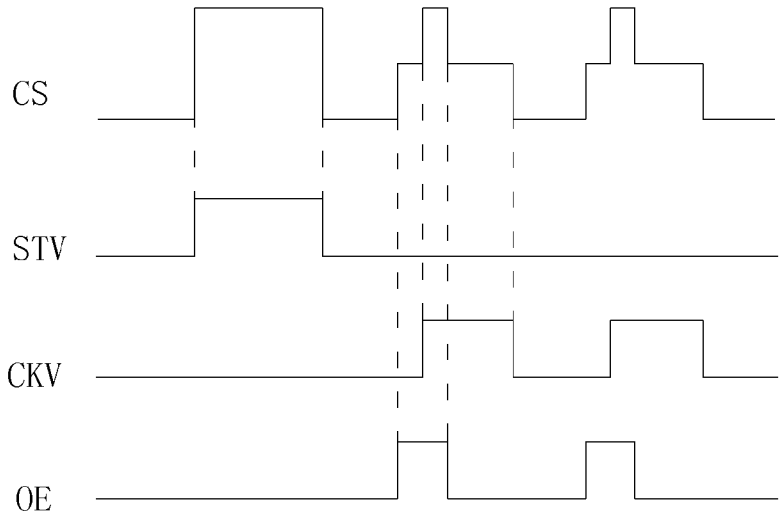
FIG. 2 is a structural and illustrational view of a driving waveform provided by one embodiment of the present invention and a driving waveform after decoded.

Referring to FIG. 2, which is a driving method for a liquid crystal display panel provided by the present embodiment, comprising a timing-driven process and a scan-driven process. The timing-driven process includes the steps of generating a control signal (CS), wherein the control signal (CS) includes a preceding initial pulse signal and a plurality of following periodic timing pulse signals within a valid display time. The initial pulse signal has a first rising edge rising from a low voltage to a high voltage and a first falling edge falling from the high voltage to the low voltage; and the timing pulse signal has a second rising edge rising from a low voltage to an intermediate voltage, a third rising edge rising from the intermediate voltage to a high voltage, a second falling edge falling from the high voltage to the intermediate voltage, and a third falling edge falling from the intermediate voltage to the low voltage.

The scan-driven process includes the steps of: a receiving step for receiving a control signal (CS) from a timing-driven circuit; a converting step for generating a target control signal based on the control signal (CS); and an outputting step for outputting a scan-driven signal used for driving a liquid crystal display panel based on the target control signal.

Preferably, in the converting step, the target control signal based on the control signal (CS) includes a start voltage pulse (STV) signal, a clock voltage pulse (CKV) signal, and an output enable (OE) signal, substantially including the sub-steps of: converting the initial pulse signal into the start voltage pulse (STV) signal; and converting the timing pulse signal into the clock voltage pulse (CKV) signal and the output enable (OE) signal. Wherein a first rising edge of the initial pulse signal is a rising edge of the start voltage pulse (STV) signal, and a first falling edge of the initial pulse signal is a falling edge of the start voltage pulse (STV) signal; a second rising edge of the timing pulse signal is a rising edge of the output enable (OE) signal, and a second falling edge of the timing pulse signal is a falling edge of the output enable (OE) signal; and a third rising edge of the timing pulse signal is a rising edge of the clock voltage pulse (CKV) signal, and a third falling edge of the timing pulse signal is a falling edge of the clock voltage pulse (CKV) signal.

Figure 3:
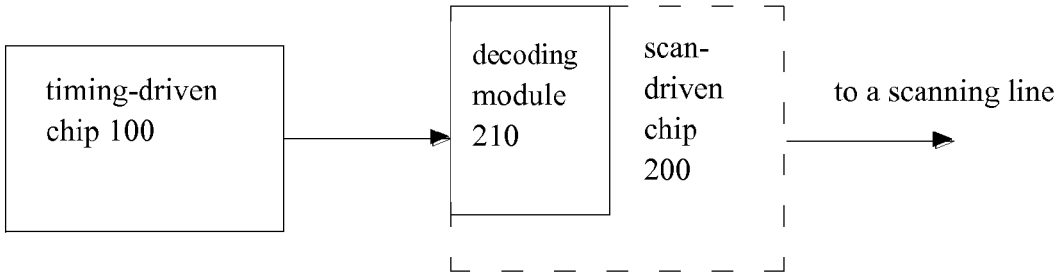
FIG. 3 is a structural and illustrational view of a driving circuit for a liquid crystal display panel provided by one embodiment of the present invention.

The present embodiment further provides a driving circuit for a liquid crystal display panel, such as shown in FIG. 3, including a timing-driven chip 100, a scanning line, and a scan-driven chip 200 coupled to the scanning line, wherein the scan-driven chip 200 includes a decoding module 210. The timing-driven chip 100 outputs a control signal (CS) to the scan-driven chip 200, in a preferred embodiment, and there is only one conducting trace for transmitting the control signal (CS) between the timing-driven chip 100 and the scan-driven chip 200. The control signal (CS) includes a preceding initial pulse signal and a plurality of following timing pulse signals within a valid display time. The initial pulse signal has a first rising edge rising from a low voltage to a high voltage and a first falling edge falling from the high voltage to the low voltage; and the timing pulse signal has a second rising edge rising from a low voltage to an intermediate voltage, a third rising edge rising from the intermediate voltage to a high voltage, a second falling edge falling from the high voltage to the intermediate voltage, and a third falling edge falling from the intermediate voltage to the low voltage.

The scan-driven chip 200 decodes the control signal (CS) to a target control signal including the start voltage pulse (STV) signal, the clock voltage pulse (CKV) signal, and the output enable (OE) signal via the decoding module 210 after receiving the control signal (CS), substantially including the sub-steps of: converting the initial pulse signal into the start voltage pulse (STV) signal; and converting the timing pulse signal into the clock voltage pulse (CKV) signal and the output enable (OE) signal. Wherein a first rising edge of the initial pulse signal is a rising edge of the start voltage pulse (STV) signal, and a first falling edge of the initial pulse signal is a falling edge of the start voltage pulse (STV) signal; a second rising edge of the timing pulse signal is a rising edge of the output enable (OE) signal, and a second falling edge of the timing pulse signal is a falling edge of the output enable (OE) signal; and a third rising edge of the timing pulse signal is a rising edge of the clock voltage pulse (CKV) signal, and a third falling edge of the timing pulse signal is a falling edge of the clock voltage pulse (CKV) signal.

The scan-driven chip 200 outputs a scan-driven signal to the scanning line based on the target control signal, wherein the scan-driven signal is used for driving a liquid crystal display panel.

In conclusion, according to the driving method and the driving circuit for a liquid crystal display panel provided by the present invention, the timing-driven chip transmits a control signal to the scan-driven chip, and the scan-driven chip decodes the control signal to the start voltage pulse signal, the clock voltage pulse signal, and the output enable signal for controlling the output of the scan signal. Thus, there will only need one conducting trace for transmitting the control signal between the timing-driven chip and the scan-driven chip, and thereby the conducting trace of a liquid crystal display panel can be reduced, which can reduce the difficulty of design and the manufacturing cost.

It should be noted that, in this paper, such as the first and second terms of the type of relationship will only be used to operate with one entity or another entity or operate separate, but not necessarily required, or between these entities or operations imply the existence of any such actual relationship or order. Moreover, the term "comprising", "including" or any other variants thereof are intended to cover a non-exclusive inclusion, such that a number of elements including the process, method, article, or device including not only those elements, but also not explicitly listed other elements, or also for such process, method, article, or those elements inherent device. In the case where no more restrictions, by the statement "includes a . . . " qualified elements, including the said element does not exclude a process, method, article or device is also the same as the other elements present.

Although embodiments of the present invention have been described, persons of the skilled in the art should understand that any modification of equivalent structure or equivalent process without departing from the spirit and scope of the present invention limited by the claims is allowed.

The invention claimed is:

1. A driving method for a liquid crystal display panel, comprising a timing-driven process and a scan-driven process, wherein the timing-driven process includes the steps of:

A. generating an initial pulse signal, which has a first rising edge rising from a low voltage to a high voltage and a first falling edge falling from the high voltage to the low voltage; and B. generating a timing pulse signal, which has a second rising edge rising from a low voltage to an intermediate voltage, a third rising edge rising from the intermediate voltage to a high voltage, a second falling edge falling from the high voltage to the intermediate voltage, and a third falling edge falling from the intermediate voltage to the low voltage;

wherein the scan-driven process includes the step of:

a receiving step for receiving a control signal from a timing-driven circuit;

a converting step for generating a target control signal based on the control signal, the target control signal including a start voltage pulse signal, a clock voltage pulse signal and an output enable signal; and an outputting step for outputting a scan-driven signal used for driving a liquid crystal display panel based on the target control signal;

wherein the converting step includes the sub-steps of:

converting the initial pulse signal into the star voltage pulse signal;

converting the timing pulse signal into the clock voltage pulse signal and the output enable signal, wherein a rising edge of the clock voltage pulse signal is the third rising edge of the timing pulse signal; a falling edge of the clock voltage pulse signal is the third rising edge of the timing pulse signal; a rising edge of the output enable signal is the second rising edge of the timing pulse signal; and a falling edge of the output enable signal is the second falling edge of the timing pulse signal.

2. The driving method as recited in claim 1, wherein the control signal includes a preceding initial pulse signal and a plurality of following timing pulse signals within a valid display time.

3. A driving circuit for a liquid crystal display panel, comprising a timing-driven chip, a scanning line, and a scan-driven chip coupled to the scanning line, wherein the timing-driven chip transmits a control signal to the scan-driven chip, and wherein the control signal includes an initial pulse signal, which has a first rising edge rising from a low voltage to a high voltage and a first falling edge falling from the high voltage to the low voltage; and a timing pulse signal, which has a second rising edge rising from a low voltage to an intermediate voltage, a third rising edge rising from the intermediate voltage to a high voltage, a second falling edge falling from the high voltage to the intermediate voltage, and a third falling edge falling from the intermediate voltage to the low voltage;

wherein the scan-driven chip includes a decoding module for converting the control signal into a target control signal; and the scan-driven chip outputs a scan-driven signal for driving the liquid crystal display panel based on the target control signal;

wherein the target control signal includes a start voltage pulse signal, a clock voltage pulse signal, and an output enable signal;

wherein the decoding module converts the initial pulse signal into the start voltage pulse signal and converts the timing pulse signal into the clock voltage pulse signal and the output enable signal, wherein a rising edge of the clock voltage pulse signal is the third rising edge of the timing pulse signal; a falling edge of the clock voltage pulse signal is the third falling edge of the timing pulse signal; a rising edge of the output enable signal is the second rising edge of the timing pulse signal; and a falling edge of the output enable signal is the second falling edge of the timing pulse signal.

4. The driving circuit as recited in claim 3, wherein there is only one conducting trace for transmitting the control signal between the timing-driven chip and the scan-driven chip.

5. The driving circuit as recited in claim 3, wherein the control signal includes a preceding initial pulse signal and a plurality of following timing pulse signals within a valid display time.

6. The driving circuit as recited in claim 4, wherein the control signal includes a preceding initial pulse signal and a plurality of following timing pulse signals within a valid display time.

* * * * *